US006370347B1

(12) United States Patent
Shin et al.

(10) Patent No.: US 6,370,347 B1
(45) Date of Patent: Apr. 9, 2002

(54) SQUEEZING APPARATUS OF A LIQUID ELECTROPHOTOGRAPHIC COLOR PRINTER

(75) Inventors: Hyun-seong Shin, Suwon; Seung-young Byun, Sungnam, both of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/643,737

(22) Filed: Aug. 23, 2000

(30) Foreign Application Priority Data

Nov. 19, 1999 (KR) ..... 99-51603

(51) Int. Cl.[7] ..... G03G 15/10
(52) U.S. Cl. ..... 399/249
(58) Field of Search ..... 399/233, 237, 399/249, 348, 349, 357

(56) References Cited

U.S. PATENT DOCUMENTS

| | | | | | |
|---|---|---|---|---|---|
| 4,023,899 | A | * | 5/1977 | Hayashi et al. | 399/237 X |
| 4,052,959 | A | * | 10/1977 | Hayashi et al. | 399/249 |
| 4,325,627 | A | * | 4/1982 | Swidler et al. | 399/249 |
| 4,353,639 | A | * | 10/1982 | Moraw et al. | 399/249 |
| 4,390,268 | A | * | 6/1983 | Furuichi et al. | 399/348 |
| 4,990,962 | A | * | 2/1991 | Kishi | 399/233 |
| 5,323,213 | A | * | 6/1994 | Ahn | 399/357 X |
| 5,884,127 | A | * | 3/1999 | Kim et al. | 399/249 |
| 5,907,741 | A | * | 5/1999 | Matsuzawa et al. | |
| 6,104,901 | A | * | 8/2000 | Imamiya | 399/249 |
| 6,305,860 | B1 | * | 10/2001 | Park | 399/249 X |

* cited by examiner

*Primary Examiner*—Susan S. Y. Lee
(74) *Attorney, Agent, or Firm*—Sughrue Mion, PLLC

(57) ABSTRACT

A squeezing apparatus of a liquid electrophotographic color printer for removing carrier of a developer from the developer without causing any damage to an image developed on a photosensitive medium. The squeezing apparatus includes a dual-structure squeezing roll that has a squeezing roll section of a low peel force for squeezing out and removing the carrier from the developer applied to the image area of the photosensitive medium, by its passive-rotational movement while being forced against the image area of the photosensitive medium by a certain force. The squeezing apparatus also includes a pair of friction roll sections, each friction roll section disposed at an end of the squeezing roll section with a gap to oppose each other at a certain interval, the friction roll sections having a high dry-friction coefficient and are passive-rotated while being forced into tight contact with the non-image area of the photosensitive medium by a certain force. The squeezing roll section is made of a material having a low peel force such as silicon, and the friction roll sections are made of a material having a high dry-friction coefficient such as urethane. Accordingly, the attraction of the toner of the photosensitive medium onto the squeezing roll by the low peel force of the squeezing roll section, and the slippage of the squeezing roll during a rotation of the squeezing roll by a high friction force of the friction roll sections are prevented. Accordingly, the image smearing by the slipping of squeezing roll and squeezing offset error can be prevented. Further, by forming the squeezing roll section with a material of a low friction coefficient, the driving load is reduced during the reverse-rotation of the squeezing roll in the drip line removing mode, and damage to the photosensitive medium is reduced.

7 Claims, 3 Drawing Sheets

SQUEEZING APPARATUS OF A LIQUID ELECTROPHOTOGRAPHIC COLOR PRINTER

BACKGROUND OF THE INVENTION

1. Field of the Invention

The present invention relates to a liquid electrophotographic color printer using a developer composed of a powder toner and a liquid carrier, i.e. a solvent, and more particularly, to a squeezing apparatus of a liquid electrophotographic color printer for removing both the carrier of the developer and the residual developer left after a developing operation.

2. Description of the Prior Art

Generally, a liquid electrophotographic color printer includes a belt type photosensitive medium 1, as shown in FIG. 1. The photosensitive medium 1 is wound around rolls 2, 3, 4 and travels in a certain path in a body of the printer (not shown). Around the photosensitive medium 1, an electric charging unit 10, exposure unit (not shown), developing units 20*a*, 20*b*, 20*c*, 20*d*, drying unit 30, and transfer/fixing unit 40 are disposed. Further, developer feeding devices (not shown) adjacent to the developing units 20*a*, 20*b*, 20*c*, 20*d* are disposed to feed the developer of a certain density to the developing units 20*a*, 20*b*, 20*c*, 20*d*.

An electrostatic latent image is formed on the photosensitive medium 1 by the exposure unit (not shown), and is developed by the developing units 20*a*, 20*b*, 20*c*, 20*d* which jet the developer on to the photosensitive medium 1, separate most of the carrier from the developer to retain the toner of the developer at the electrostatic latent image area of the photosensitive medium 1. The carrier is removed during the developing operation since excess carrier at the image formed on the photosensitive medium 1 by the toner, hinders an image transfer of the transfer/fixing unit 40. The residual carrier which is not removed by the developing units 20 is removed while the photosensitive medium 1 passes through the drying unit 30.

Accordingly, as shown in FIG. 2, each one of developing units (e.g., developing unit 20*a*) includes a developer jetting nozzle 22, developing roll 24, developing backup roll 26, developer recovery tank 28, and a squeezing device 60 for removing the carrier. Here, the squeezing device 60 includes a squeezing roll 62 and a squeezing backup roll 64.

The squeezing device 60 is described below in greater detail with reference to FIG. 3.

As shown in FIG. 3, the squeezing roll 62 is disposed to be selectively forced against a surface of the photosensitive medium 1, while the squeezing backup roll 64 is disposed to be selectively forced against the opposite surface of the photosensitive medium 1. Further, a pair of forcing blocks 66*b*, 66*c* are disposed on a shaft 61 of the squeezing roll 62 to force the squeezing roll 62 against the squeezing backup roll 64 with a certain force, and each one of a pair of the airjet nozzles 68*b*, 68*c* are disposed at both sides of the squeezing roll 62. The air jet nozzles 68*b*, 68*c* jet air toward both ends of the squeezing roll 62, thereby preventing the developer from undesirably attaching to the ends of the squeezing roll 62 and transferring to a next color.

Further, the squeezing device 60 includes a driving section 70 for reverse-rotating the squeezing roll 62 in a drip line removing mode, and a squeezing blade 72 for removing ink on the squeezing roll 62.

The squeezing device 60, constructed as above, squeezes the carrier out of the developer applied on the surface of the photosensitive medium 1 by its passive-rotation while forcing against the surface of the photosensitive medium 1 with a certain force. Here, the squeezing roll 62 is forced by the force approximately of 20 kgf.

After the printing operation finishes, the drip line removing mode starts. During the drip line removing mode, less force is applied to the squeezing roll 62 than during the printing mode. Here, the driving section 70 rotates the squeezing roll 62 in contact with the squeezing blade 72, in the reverse direction, attracting unnecessary ink from the photosensitive medium 1. The unnecessary ink on the reverse-rotating squeezing roll 62 is removed by the squeezing blade 72 forced against the outer circumference of the squeezing roll 62.

Meanwhile, in the squeezing apparatus 60 of a liquid electrophotographic color printer having the above operation, slipping should not occur when the squeezing roll 62 is passive-rotated while being forced against the photosensitive medium 1. If slipping occurs, a smeared image is formed on the image area of the photosensitive medium 1, resulting in a deterioration of print quality. Accordingly, in order to increase a frictional force between the squeezing roll 62 and the photosensitive medium 1, the squeezing roll 62 is usually made of a material having a high friction coefficient.

While the squeezing roll 62, made of a material having a high friction coefficient, has an advantage of preventing slippage, it also has a disadvantage, i.e., a high peel force. A certain amount of toner is attached to the squeezing roll 62 with the high peel force, when the carrier is squeezed out from the developer on the photosensitive medium 1, causing squeezing offset error. Further, with the high friction coefficient of the squeezing roll 62, the image area of the photosensitive medium 1 is considerably damaged during the reverse-rotation of the squeezing roll 62 for removing the drip line.

Accordingly, slipping should be prevented and the proper peel force should be maintained when the squeezing roll 62 is driven by the photosensitive medium 1.

Conventionally, the squeezing roll 62 has a reduced peel force while having a certain degree of friction force from a TEFLON or silicon coating on the surface of the squeezing roll 62. That is, in order to prevent image smearing or squeezing offset error, a material having a certain amount of friction force which can maintain a low peel force, is employed.

In the conventional squeezing apparatus described as above, however, the squeezing is performed while the toner is left on the entire contact area between the photosensitive medium 1 and the squeezing roll 62. Even though the force of 20 kgf is applied to the photosensitive medium 1 and the squeezing roll 62, there are problems caused by the load produced by a roll deformation during a nip formation, load between a supporting structure and a roll shaft caused by the pushing force, and load of the driving elements of the driving section 70 for the drip line removing mode. The problems result in a small, but an unignorable relative speed difference between the photosensitive medium 1 and squeezing roll 62. There is a maximum 150 gm/sec relative speed difference, slightly varying depending on the colors used. Consequently, there are problems such as image smearing.

Further, the structure of the conventional squeezing roll 62, made of a material having a low peel force and a certain amount of friction coefficient, has limitations, and accordingly, a printing environment can increase the peel force of the squeezing roll 62, or the squeezing roll 62 may still slip. As a result, the problems such as the squeezing offset error caused by the increasing peel force of the squeezing roll 62, and the image smearing caused by the slip of the squeezing roll 62 can not be prevented.

SUMMARY OF THE INVENTION

The present invention has been made to overcome the above problems of the prior art, and accordingly, it is an object of the present invention to provide a squeezing apparatus of a liquid electrophotographic color printer for removing the carrier from a developer without causing any damage to a developed image on a photosensitive medium by maintaining a proper (e.g., small) amount of peel force and preventing any slips.

Another object of the present invention is to provide a squeezing apparatus of a liquid electrophotographic color printer for minimizing any possible damage to a photosensitive medium due to a squeezing roll during a drip line removing mode by decreasing a friction coefficient of the squeezing roll forced against an image area of the photosensitive medium.

The above objects are accomplished by the squeezing apparatus of a liquid electrophotographic color printer according to the present invention, including a squeezing roll for squeezing out and removing the carrier from the developer which is applied on an image area of the photosensitive medium by its passive-rotation while being forced against the photosensitive medium by a certain force.

The squeezing roll has a dual structure, since it includes a squeezing roll section, made of a material having a low peel force, which comes in contact with the image area of the photosensitive medium, and a pair of friction roll sections made of a material of a high friction coefficient which are coaxially disposed at both sides of the squeezing roll section and come in contact with a non-image area of the photosensitive medium.

The squeezing roll section is made of a material which has a low peel force such as silicon, or others, and the friction roll sections are made of a material with a high dry-friction coefficient such as urethane, or other materials. Accordingly, since the squeezing roll is passive-rotated while being forced against the photosensitive medium by the friction roll section under a high friction force, slipping does not occur. Also, since the squeezing roll section having a low peel force comes into contact with the image area of the photosensitive medium, the carrier can be exclusively squeezed out without causing any damage to the image.

The present invention prevents the squeezing roll from slipping and the toner of the developer from attaching onto the squeezing roll, to prevent image blur and squeezing offset error.

Meanwhile, TEFLON can be coated on the outer surface of the squeezing roll section. The squeezing roll section, however, can be made of any material as long as the material has a low peel force. Likewise, the friction roll section can be made of urethane, or any other material that has a high dry-friction coefficient.

Further, in the squeezing apparatus according to the present invention, each one of the friction rolls are disposed at opposite ends of the squeezing roll section, with a certain gap between each end of the squeezing roll section and the respective friction roll section. The developer is applied on the squeezing roll section, and the gaps between the squeezing roll section and the friction roll sections serve as an oil fence for preventing the developer from attaching on to the friction roll sections. Accordingly, the friction roll sections staying in a dry-friction condition at the non-image areas of the photosensitive medium can prevent slipping more efficiently.

Further, in the squeezing apparatus according to the present invention, each nozzle of a pair of airjet nozzles is disposed in a gap between the squeezing roll section and the respective friction roll section, to prevent the developer from flowing to the ends of the squeezing roll section. Further, a pair of forcing blocks are disposed on the shaft of the squeezing roll. One end of the shaft of the squeezing roll is connected with a driving section for reverse-rotating the squeezing roll in the drip line removing mode. Also, a squeezing blade is disposed to selectively come in contact with the outer circumference of the squeezing roll section for removing ink which is attached onto the squeezing roll section during the drip line removing mode.

BRIEF DESCRIPTION OF THE DRAWINGS

The above and other objects and advantages of the present invention will become readily apparent by reference to the following detailed description when considered in conjunction with the accompanying drawings wherein.

DETAILED DESCRIPTION OF THE PREFERRED EMBODIMENT

Figure 1:
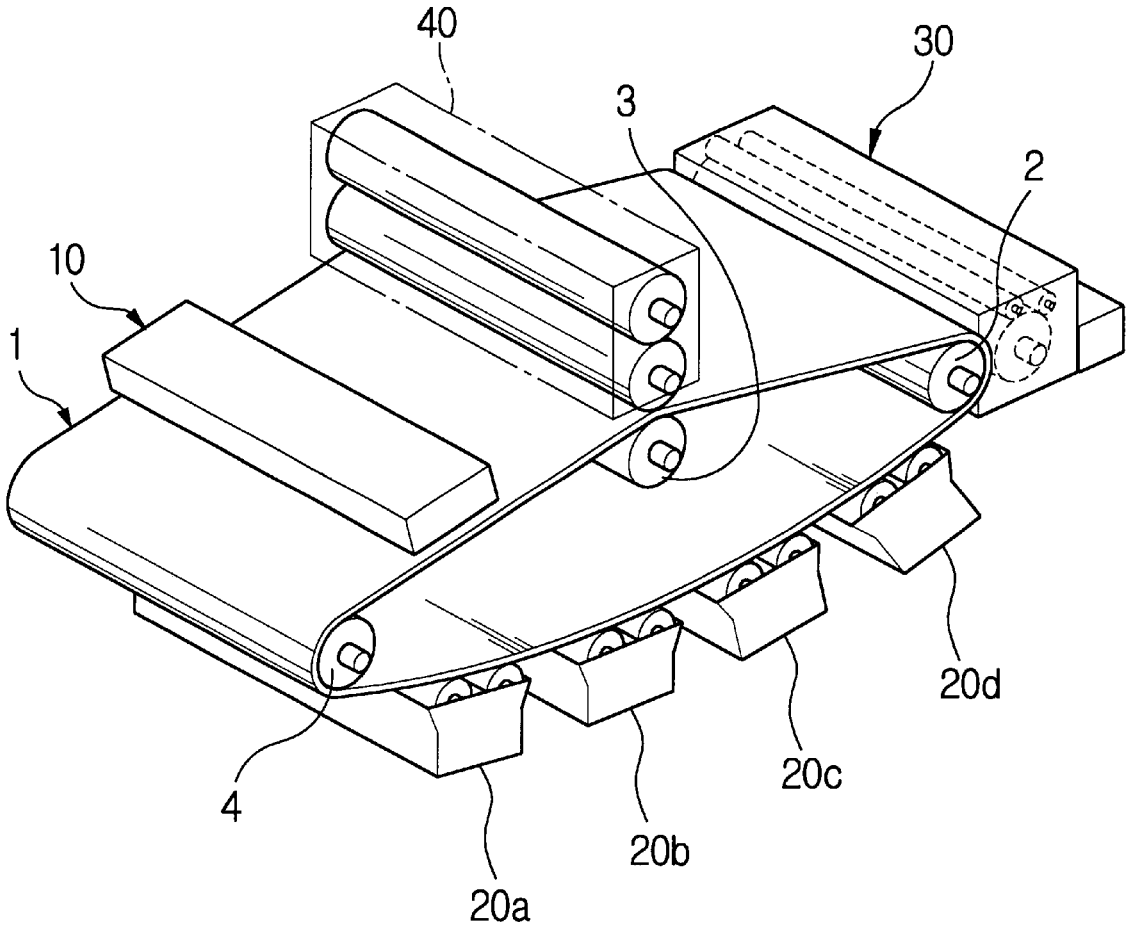
FIG. 1 (PRIOR ART)
FIG. 1 is a rear perspective view schematically showing a conventional liquid electrophotographic color printer.
Figure 2:
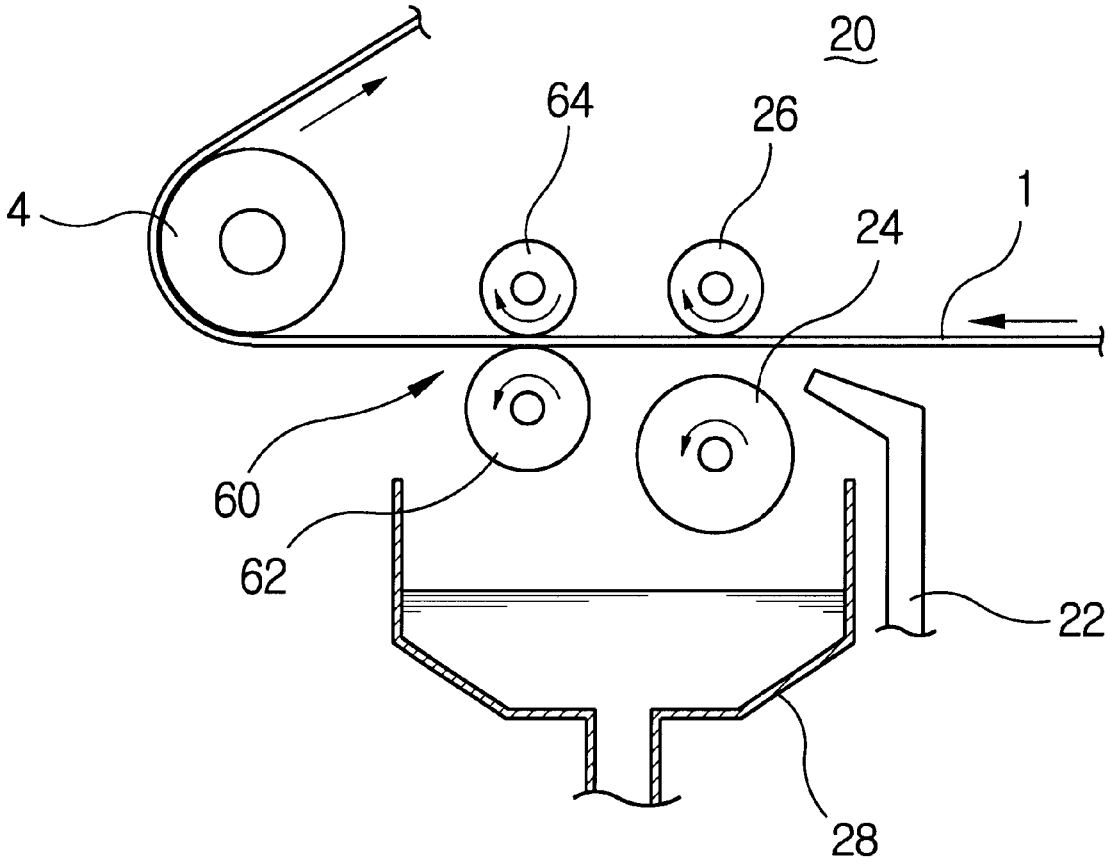
FIG.2 (PRIOR ART)
FIG. 2 is a view showing one of the developing units of the printer shown in FIG. 1.

Hereinafter, the preferred embodiment of the present invention will be described in greater detail with reference to the accompanying drawings, and the like elements are given the same reference numerals throughout the description for an easier reference.

Figure 3:
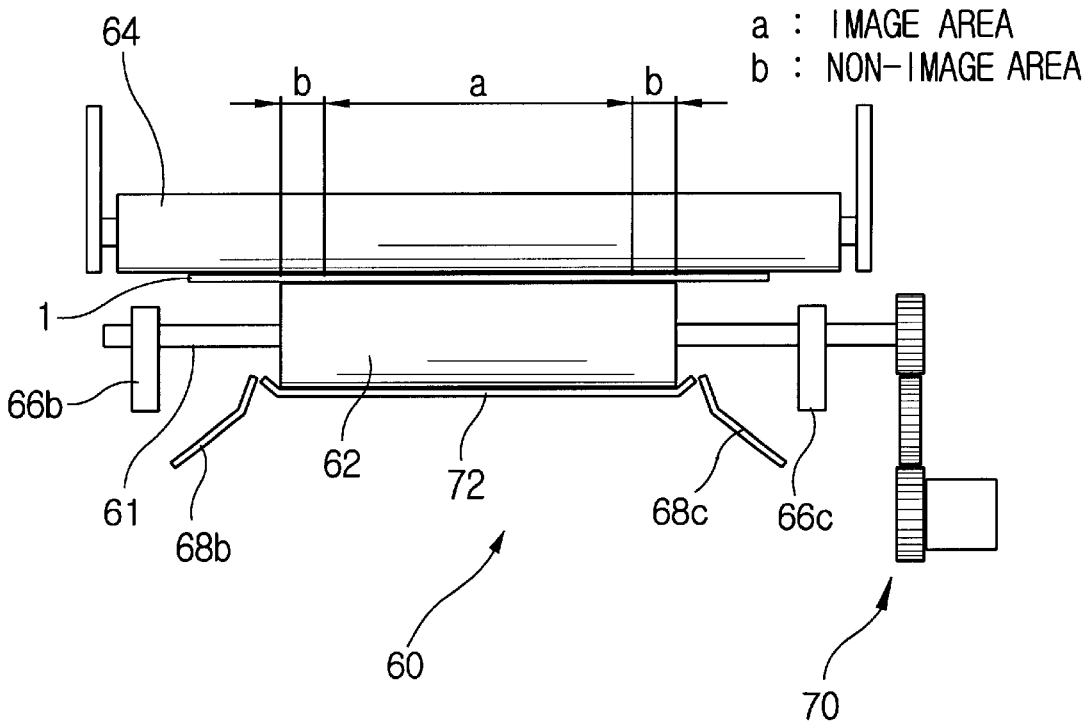
FIG.3 (PRIOR ART)
FIG. 3 is a side sectional view showing the structure of the squeezing apparatus of the printer shown in FIG. 2.
Figure 4:
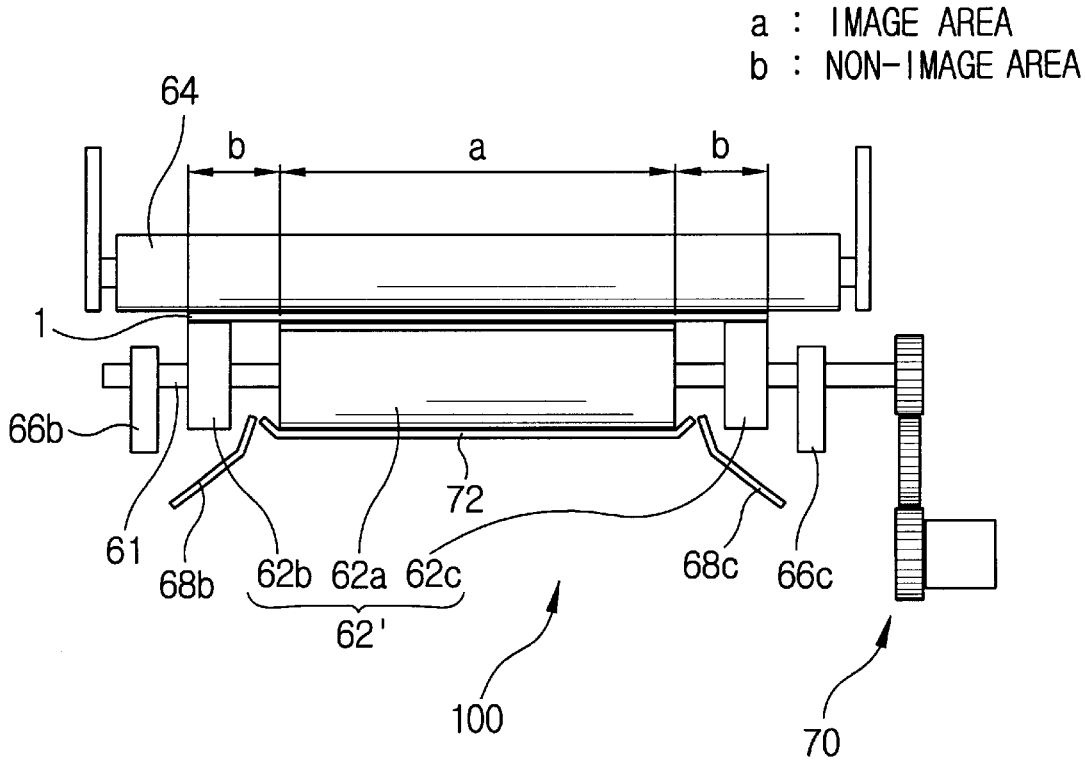
FIG. 4 is a sectional view corresponding to FIG. 3 showing the structure of a squeezing apparatus of a liquid electrophotographic color printer according to a preferred embodiment of the present invention.

FIG. 4 is a view corresponding to FIG. 3, showing the structure of a squeezing apparatus 100 according to the preferred embodiment of the present invention.

As shown in FIG. 4, the squeezing apparatus 100 of the liquid electrophotographic color printer according to the present invention includes a squeezing roll 62' and a squeezing backup roll 64.

The squeezing roll 62' is disposed to be selectively forced against a surface of the photosensitive medium 1, while the squeezing backup roll 64 is disposed to be selectively forced against the opposite surface of the photosensitive medium 1.

According to the present invention, the squeezing roll 62' is of a dual structure which has a squeezing roll section **62*a*, and a pair of coaxial friction sections 62*b*, 62*c*, each friction section disposed at opposite ends of the squeezing roll section 62*a***.

The squeezing roll section **62*a* is made of a material having a low peel force, and squeezes and removes the carrier out of the developer applied on the image area of the photosensitive medium 1, by its passive-rotational movement while being forced against the image area by a certain degree of force. Further, each of the friction roll sections 62*b*, 62*c* is made of a material having a high dry-friction coefficient, and passive-rotates while being forced against the non-image area of the photosensitive medium 1 by a certain force. Here, the squeezing roll section 62***a* is made of a material having a low peel force, such as silicon, or other suitable materials. Although the squeezing roll section 62*a* is made of silicon in this embodiment, it is not strictly limited to silicon only. Any suitable material or combination of materials can be used for various squeezing roll section designs as long as the squeezing roll section 62*a* has a low peel force. For example, a coating of TEFLON, or other materials can be applied on the squeezing roll section 62*a*. The friction roll sections 62*b*, 62*c* are made of a material having a high dry-friction coefficient such as urethane, or other suitable materials. Any suitable material or combination of materials can be used for various friction roll section designs as long as the friction roll sections 62*b*, 62*c* have a high dry-friction coefficient.

Each one of the pair of friction roll sections 62*b*, 62*c* is disposed at an opposite end of the squeezing roll section 62*a* with a gap between the squeezing roll section 62*a* and each one of the friction roll sections 62*b*, 62*c*. The gaps serve as an oil fence for blocking the developer of the squeezing roll 62*a* from getting on the friction roll sections 62*b*, 62*c*. Accordingly, the friction roll sections 62*b*, 62*c* maintain dry-friction status, and any slippage of the squeezing roll 62' can be prevented more efficiently.

The squeezing apparatus 100 according to the present invention further includes a pair of forcing blocks 66*b*, 66*c* for forcing the squeezing roll 62' against the squeezing backup roll 64 with a certain force. The forcing blocks 66*b*, 66*c* are disposed on a shaft 61 of the squeezing roll 62'.

Further, the squeezing apparatus 100 according to the present invention includes a pair of air jet nozzles 68*b*, 68*c* disposed in the gaps between the squeezing roll section 62*a* and each one of the pair of friction roll sections 62*b*, 62*c*. The air jet nozzles 68*b*, 68*c* jet air toward both ends of the squeezing roll section 62*a*, and thus, prevent the developer from undesirably attaching to the ends of the squeezing roll section 62*a* and moving to the next color.

Moreover, the squeezing apparatus 100 according to the present invention includes a driving section 70 for reverse-rotating the squeezing roll 62' during the drip line removing mode, and a squeezing blade 72 for removing the ink attached to the squeezing roll 62'.

In the squeezing apparatus 100 constructed as above, according to the present invention, the squeezing roll 62' is passive-rotated while being forced against the surface of the moving photosensitive medium 1, to squeeze the carrier out of the developer applied on the surface of the photosensitive medium 1, during a printing operation. Here, the squeezing roll section 62*a* comes into contact with the image area of the photosensitive medium 1, removing the carrier. The pair of friction roll sections 62*b*, 62*c* serves as a passive-rotation drive source of the squeezing roll 62' which is passive-rotated.

More specifically, the squeezing roll 62' according to the present invention includes a squeezing roll section 62*a* having a low peel force for performing the squeezing operation of the squeezing roll 62', and the friction roll sections, 62*b*, 62*c*, i.e., the driving section for passive-rotating the squeezing roll 62'. Here, since the developer is between the squeezing roll section 62*a* and the image area of the photosensitive medium exclusively, the slip of the squeezing roll or offset error, etc., can be prevented.

After the completion of the printing operation, the drip line removing mode is performed, and in such a situation, the squeezing roll 62' is forced by a lower force than in the printing mode. The unnecessary ink on the photosensitive medium 1 is attracted onto the squeezing roll 62' which is passive-rotated by the driving section 70, and the squeezing blade 72 in contact with the outer circumference of the squeezing roll 62' removes unnecessary ink on the squeezing roll 62'.

As described above, according to the present invention, a pair of friction roll sections 62*b*, 62*c* having a high dry-friction coefficient are passive-rotated and forced against the non-image area of the photosensitive medium 1, and the squeezing roll section 62*a* having a low peel force comes into contact with the image area of the photosensitive medium to squeeze out and remove the carrier from the developer applied on the image area of the photosensitive medium 1. Accordingly, there is no slip between the photosensitive medium 1 and the squeezing roll 62', and the image of the photosensitive medium is not attracted onto the squeezing roll 62' due to the low peel force of the squeezing roll section 62*a*. As a result, image smearing caused by the slip of the squeezing roll 62', and the squeezing offset error caused by the image attracting to the squeezing roll 62' can be prevented.

Further, according to the present invention, the load at the driving section 70 is significantly reduced in the drip line removing mode because the squeezing roll section 62*a* is made of a material having a low friction coefficient. Consequently, the damage to the photosensitive medium 1 can be minimized.

As stated above, the preferred embodiment of the present invention is shown and described. Although the preferred embodiment of the present invention has been described, it is understood that the present invention should not be limited to this preferred embodiment but various changes and modifications can be made by one skilled in the art within the spirit and scope of the present invention as hereinafter claimed.

What is claimed is:

1. A squeezing apparatus of a liquid electrophotographic color printer including a squeezing roll for squeezing out and removing a carrier from developer applied to an image area of a photosensitive medium, by passive-rotational movement of the squeezing roll, while being forced against the photosensitive medium traveling along a certain path, by a certain force, wherein the squeezing roll comprises:

a squeezing roll section made of a material having a low peel force so that the image area of the photosensitive medium is not attracted onto the squeezing roll which comes into contact with the image area of the photosensitive medium; and a pair of friction roll sections, each made of a material having a high friction coefficient so that the friction roll sections do not slip with respect to the photosensitive medium, and coaxially disposed at both sides of the squeezing roll section, which comes in contact with a non-image area of the photosensitive medium.

2. The squeezing apparatus as claimed in claim 1, wherein the squeezing roll section is made of silicon.

3. The squeezing apparatus as claimed in claim 1, wherein the pair of friction roll sections are made of urethane.

4. The squeezing apparatus as claimed in claim 1, wherein the squeezing roll section is coated with a layer of at least one of silicon and TEFLON on an outer circumference, and each one of the pair of friction roll sections is coated with a layer of urethane on the outer circumference.

5. The squeezing apparatus as claimed in claim 1, wherein each one of the pair of friction roll sections is at a side of the squeezing roll section to form a gap between the squeezing roll section and each one of the pair of friction roll sections, the gaps serving as an oil fence for preventing developer attachment on the friction roll sections, for maintaining a dry-friction status between the non-image areas of the photosensitive medium and the friction roll sections.

6. A squeezing apparatus of a liquid electrophotographic color printer including a dual-structure squeezing roll, wherein the dual-structure squeezing roll comprises:

a squeezing roll section having a low peel force so that an image of a photosensitive medium is not attracted onto the squeezing roll, for squeezing out and removing a carrier from a developer applied to an image area of a photosensitive medium by passive-rotational movement while being forced against the image area of the photosensitive medium by a certain force;

a pair of friction roll sections, each one disposed at a side of the squeezing roll section, the pair separated by a certain distance, the friction roll sections having a high dry-friction coefficient so that the friction roll sections do not slip with respect to the photosensitive medium, and passive-rotating while being forced against the non-image area of the photosensitive medium by a certain force;

a squeezing backup roll opposed to the squeezing roll, with the photosensitive medium disposed between the squeezing backup roll and the squeezing roll;

forcing means for forcing the squeezing roll with a certain force against the squeezing backup roll;

a pair of air jet nozzles, each nozzle disposed in a gap between the squeezing roll section and each of the pair of friction roll sections, for jetting high pressure air to prevent the developer from flowing to the sides of the squeezing roll section; and drip line removing means.

7. The squeezing apparatus as claimed in claim 6, wherein the drip line removing means comprises:

a driving section connected to a shaft of the squeezing roll for reverse-rotating the squeezing roll; and a squeezing blade for selectively coming into contact with the outer circumference of the squeezing roll, wherein the squeezing roll is reverse-rotated by the driving section, for removing ink attached on the squeezing roll.

* * * * *